US008807273B2

(12) United States Patent
Murakami et al.

(10) Patent No.: US 8,807,273 B2
(45) Date of Patent: Aug. 19, 2014

(54) EXHAUST MUFFLER DEVICE

(71) Applicant: Honda Motor Co., Ltd., Tokyo (JP)

(72) Inventors: Atsushi Murakami, Wako (JP); Hiroshi Mahira, Wako (JP); Tadahisa Masatani, Wako (JP); Kensuke Honma, Wako (JP); Shiro Kokubu, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 13/754,246

(22) Filed: Jan. 30, 2013

(65) Prior Publication Data

US 2013/0199869 A1 Aug. 8, 2013

(30) Foreign Application Priority Data

Feb. 3, 2012 (JP) ..... 2012-022010

(51) Int. Cl.

| | |
|---|---|
| ***F01N 1/08*** | (2006.01) |
| ***F01N 3/10*** | (2006.01) |
| *F01N 1/00* | (2006.01) |
| *F01N 13/14* | (2010.01) |

(52) U.S. Cl.
USPC ..... 181/228; 181/258

(58) Field of Classification Search
USPC ..... 181/228, 227, 258, 282; 422/179, 180, 422/168; 60/299, 302
See application file for complete search history.

(56) References Cited

U.S. PATENT DOCUMENTS

| | | | | | |
|---|---|---|---|---|---|
| 4,093,423 | A * | 6/1978 | Neumann | 422/180 |
| 4,163,041 | A * | 7/1979 | Gaysert | 422/179 |
| 4,779,703 | A * | 10/1988 | Takiguchi et al. | 181/228 |
| 5,055,274 | A * | 10/1991 | Abbott | 422/171 |
| 5,338,903 | A * | 8/1994 | Winberg | 181/231 |
| 5,426,269 | A * | 6/1995 | Wagner et al. | 181/232 |
| 5,724,735 | A * | 3/1998 | Ickes et al. | 29/890 |
| 5,980,837 | A * | 11/1999 | Umin et al. | 422/179 |
| 6,017,498 | A * | 1/2000 | Harding | 422/179 |
| 6,338,826 | B2 * | 1/2002 | Yamada et al. | 422/180 |
| 7,179,429 | B1 * | 2/2007 | Maus | 422/179 |
| 7,306,772 | B2 * | 12/2007 | Yamaguchi et al. | 422/179 |
| 7,438,157 | B2 * | 10/2008 | Schorn et al. | 181/237 |
| 8,092,748 | B2 * | 1/2012 | Forster et al. | 422/177 |
| 2002/0068025 | A1 * | 6/2002 | Foster et al. | 422/179 |
| 2005/0163676 | A1 * | 7/2005 | Kato | 422/179 |
| 2006/0245986 | A1 * | 11/2006 | Roe et al. | 422/179 |
| 2013/0255238 | A1 * | 10/2013 | Murakami et al. | 60/299 |

FOREIGN PATENT DOCUMENTS

| | | | | |
|---|---|---|---|---|
| DE | 3504839 | A1 * | 8/1986 | B01D 53/36 |
| JP | 04303107 | A * | 10/1992 | F01N 3/20 |
| JP | 2000-337139 | A | 12/2000 | |

* cited by examiner

*Primary Examiner* — Edgardo San Martin

(74) *Attorney, Agent, or Firm* — Squire Patton Boggs (US) LLP

(57) ABSTRACT

An exhaust muffler device has a ceramic catalyst body, and a holding tube having an end portion configured to hold the ceramic catalyst body therein with a holding mat therebetween. The end portion is reduced in diameter to form a reduced diameter portion. An exhaust pipe is connected to the holding tube, with a downstream end portion thereof being fitted to an inner circumference of the reduced diameter portion of the holding tube. An inner circumferential surface of the downstream end portion of the exhaust pipe is in proximity to a boundary portion of the holding mat and the ceramic catalyst body.

20 Claims, 5 Drawing Sheets

EXHAUST MUFFLER DEVICE

BACKGROUND

1. Field

The present invention relates to an exhaust muffler device for an engine which includes a ceramic catalyst body therein.

2. Description of the Related Art

Heretofore, catalytic units provided to exhaust muffler devices and the like have been known in which a mat as a holder is wrapped around the outer circumference of a ceramic catalyst body, and the ceramic catalyst body is held inside a cylindrical holding tube such as a metal case with the holder therebetween, as shown, for example, in Patent Document 1 (Japanese Patent Application Publication No. 2000-337139). In Patent Document 1, an exhaust pipe connected to the upstream end of the holding tube is fitted to an inner circumferential portion of the upstream end of the holding tube, and the end of an inner circumferential portion of the exhaust pipe is arranged at a position in proximity to the mat.

However, in the conventional catalytic unit described above, since the end of the inner circumferential portion of the exhaust pipe is arranged in proximity to the mat, exhaust gas that flows along the inner wall of the exhaust pipe directly hits an end portion of the mat. For this reason, there is a possibility that a large amount of exhaust gas may enter the inside of the mat and/or that the flow of the exhaust gas may become turbulent in the vicinity of the end portion of the mat.

SUMMARY

The present invention has been made in view of the above circumstances, and an object thereof is to make an exhaust muffler device including a ceramic catalyst body therein capable of preventing a large amount of exhaust gas from entering the inside of a mat and also preventing the flow of the exhaust gas from becoming turbulent in the vicinity of the mat.

For the purpose of solving the above-mentioned problems, embodiments of the present invention include an exhaust muffler device for an engine which includes a ceramic catalyst body therein. An end portion of a holding tube which holds the ceramic catalyst body therein with a holding mat in between is reduced in diameter to form a reduced diameter portion. A downstream end portion of an exhaust pipe connected to the holding tube is fitted to an inner circumference of the reduced diameter portion of the holding tube. The end portion of the holding tube can be welded or otherwise fixed to the downstream end portion of the exhaust pipe in such a way that an inner circumferential surface of the downstream end portion of the exhaust pipe is in proximity to a boundary portion of the holding mat and the ceramic catalyst body.

According to this configuration, the end portion of the holding tube which holds the ceramic catalyst body therein with the holding mat in between is reduced in diameter to form the reduced diameter portion. The downstream end portion of the exhaust pipe connected to the holding tube is fitted to the inner circumference of the reduced diameter portion of the holding tube. The end portion of the holding tube is welded and fixed to the downstream end portion of the exhaust pipe in such a way that the inner circumferential surface of the downstream end portion of the exhaust pipe is in proximity to the boundary portion of the holding mat and the ceramic catalyst body. Thus, exhaust gas flowing along the inner circumferential surface of the downstream end portion of the exhaust pipe flows into the ceramic catalyst body smoothly, without hitting the holding mat. Accordingly, it is possible to prevent a large amount of exhaust gas from entering the inside of the mat and also to prevent the flow of the exhaust gas from becoming turbulent in the vicinity of the mat.

In addition, in the above configuration, the inner circumferential surface of the downstream end portion of the exhaust pipe and the boundary portion may be located at substantially the same position in a radial direction.

In this case, since the inner circumferential surface of the downstream end portion of the exhaust pipe and the boundary portion are located at substantially the same position in the radial direction, exhaust gas flowing along the inner circumferential surface of the downstream end portion of the exhaust pipe flows into the ceramic catalyst body smoothly, without hitting the holding mat. Accordingly, it is possible to prevent a large amount of exhaust gas from entering the inside of the mat and also to prevent the flow of the exhaust gas from becoming turbulent in the vicinity of the mat.

Moreover, the holding mat may be formed such that a longitudinal size thereof is smaller than the longitudinal size of the ceramic catalyst body, and an end portion of the holding mat adjacent to the downstream end portion of the exhaust pipe may be provided in proximity to an end portion of the ceramic catalyst body adjacent to the downstream end portion of the exhaust pipe.

In this case, since the holding mat is formed such that the longitudinal size thereof is smaller than the longitudinal size of the ceramic catalyst body, and the end portion of the holding mat adjacent to the downstream end portion of the exhaust pipe is provided in proximity to the end portion of the ceramic catalyst body adjacent to the downstream end portion of the exhaust pipe, at the time of assembling the ceramic catalyst body into the holding tube by press fitting or the like, the holding mat can be prevented from sticking out in the longitudinal direction. Moreover, an unnecessary space can be prevented from being formed around the downstream end portion of the exhaust pipe due to displacement between the end portion of the holding mat and the end portion of the ceramic catalyst body. Accordingly, it is possible to improve the workability of the assembling, and also to prevent exhaust gas from becoming turbulent and thereby improve the engine performance.

Further, the ceramic catalyst body may be assembled into the holding tube by inserting the ceramic catalyst body with the holding mat wrapped therearound into the holding tube together with the holding mat from a downstream end of the holding tube on the opposite side from the exhaust pipe.

In this case, since the ceramic catalyst body is assembled into the holding tube by inserting the ceramic catalyst body with the holding mat wrapped therearound into the holding tube together with the holding mat from the downstream end of the holding tube on the opposite side from the exhaust pipe, the reduced diameter portion can be formed in the holding tube in advance. Accordingly, it is possible to form the reduced diameter portion in a state where the ceramic catalyst body is yet to be assembled and therefore improve productivity during assembly.

In addition, a downstream exhaust pipe may be provided which is connected to the downstream end of the holding tube, and the end portion of the holding tube on one side is reduced in diameter to form the reduced diameter portion in advance, and the downstream exhaust pipe is inserted and connected to an inner circumferential portion of an end portion of the holding tube on the other side.

In this case, since the end portion of the holding tube on the one side is reduced in diameter to form the reduced diameter portion, and the downstream exhaust pipe is inserted and connected to the inner circumferential portion of the end portion of the holding tube on the other side, the ceramic catalyst body and the holding mat can be assembled from the end portion of the holding tube on the other side by press fitting or the like, after forming the reduced diameter portion. Accordingly, it is possible to improve productivity during assembly.

Moreover, the downstream end portion of the exhaust pipe may be formed into a conical, tapered shape by joining halved members formed by pressing a sheet member.

In this case, since the downstream end portion of the exhaust pipe is formed into a conical, tapered shape by joining the halved members formed by pressing a sheet member, it is possible to improve the design freedom for the tapered shape and also to improve productivity during assembly.

Further, the exhaust muffler device may be an exhaust muffler device for a saddle-ride type vehicle in which the holding tube is housed inside a muffler body, and the ceramic catalyst body which is a single body is arranged in a small diameter portion in an upstream side of an inside of the muffler body.

The saddle-ride type vehicle should be configured to protect peripheral components from the radiant heat of the ceramic catalyst body. Since the holding tube is housed inside the muffler body, it is possible to protect the peripheral components from the radiant heat. Moreover, since the single ceramic catalyst body is arranged in the small diameter portion in the upstream side of the inside of the muffler body, it is possible to reduce the size of the muffler and also to quickly activate the ceramic catalyst body.

In the exhaust muffler device according to embodiments of the present invention, the downstream end portion of the exhaust pipe connected to the holding tube is fitted to the inner circumference of the reduced diameter portion of the holding tube. Moreover, the end portion of the holding tube is welded and fixed to the downstream end portion of the exhaust pipe in such a way that the inner circumferential surface of the downstream end portion of the exhaust pipe is in proximity to the boundary portion of the holding mat and the ceramic catalyst body. Thus, exhaust gas flowing along the inner circumferential surface of the downstream end portion of the exhaust pipe flows into the ceramic catalyst body smoothly, without hitting the holding mat. Accordingly, it is possible to prevent a large amount of exhaust gas from entering the inside of mat and also to prevent the flow of the exhaust gas from becoming turbulent in the vicinity of the mat.

In certain embodiments, the inner circumferential surface of the downstream end portion of the exhaust pipe and the boundary portion are located at substantially the same position in the radial direction. Thus, exhaust gas flowing along the inner circumferential surface of the downstream end portion of the exhaust pipe flows into the ceramic catalyst body smoothly, without hitting the holding mat. Accordingly, it is possible to prevent a large amount of exhaust gas from entering the inside of mat and also to prevent the flow of the exhaust gas from becoming turbulent in the vicinity of the mat.

At the time of assembling the ceramic catalyst body into the holding tube by press fitting or the like, the holding mat can be prevented from sticking out in the longitudinal direction. Moreover, an unnecessary space can be prevented from being formed around the downstream end portion of the exhaust pipe due to displacement between the end portion of the holding mat and the end portion of the ceramic catalyst body. Accordingly, it is possible to improve the workability of the assembling and also to prevent exhaust gas from becoming turbulent and thereby improve the engine performance.

Further, since the ceramic catalyst body is assembled into the holding tube by inserting the ceramic catalyst body and the holding mat altogether into the holding tube from the downstream end of the holding tube on the opposite side from the exhaust pipe, the reduced diameter portion can be formed in the holding tube in advance. Accordingly, it is possible to form the reduced diameter portion in a state where the ceramic catalyst body is yet to be assembled and therefore improve the productivity.

Since the downstream end portion of the exhaust pipe can be formed into a conical, tapered shape by joining the halved members formed by pressing a sheet member, it is possible to improve the design freedom for the tapered shape and also to improve productivity during assembly.

Since the holding tube is housed inside the muffler body, it is possible to protect the peripheral components from the radiant heat. Moreover, since the single ceramic catalyst body is arranged in the small diameter portion in the upstream side of the inside of the muffler body, it is possible to reduce the size of the muffler and also to quickly activate the ceramic catalyst body.

DETAILED DESCRIPTION

A vehicle, such as a motorcycle including an exhaust muffler device according to an embodiment of the present invention, will be described with reference to the drawings.

Figure 1:
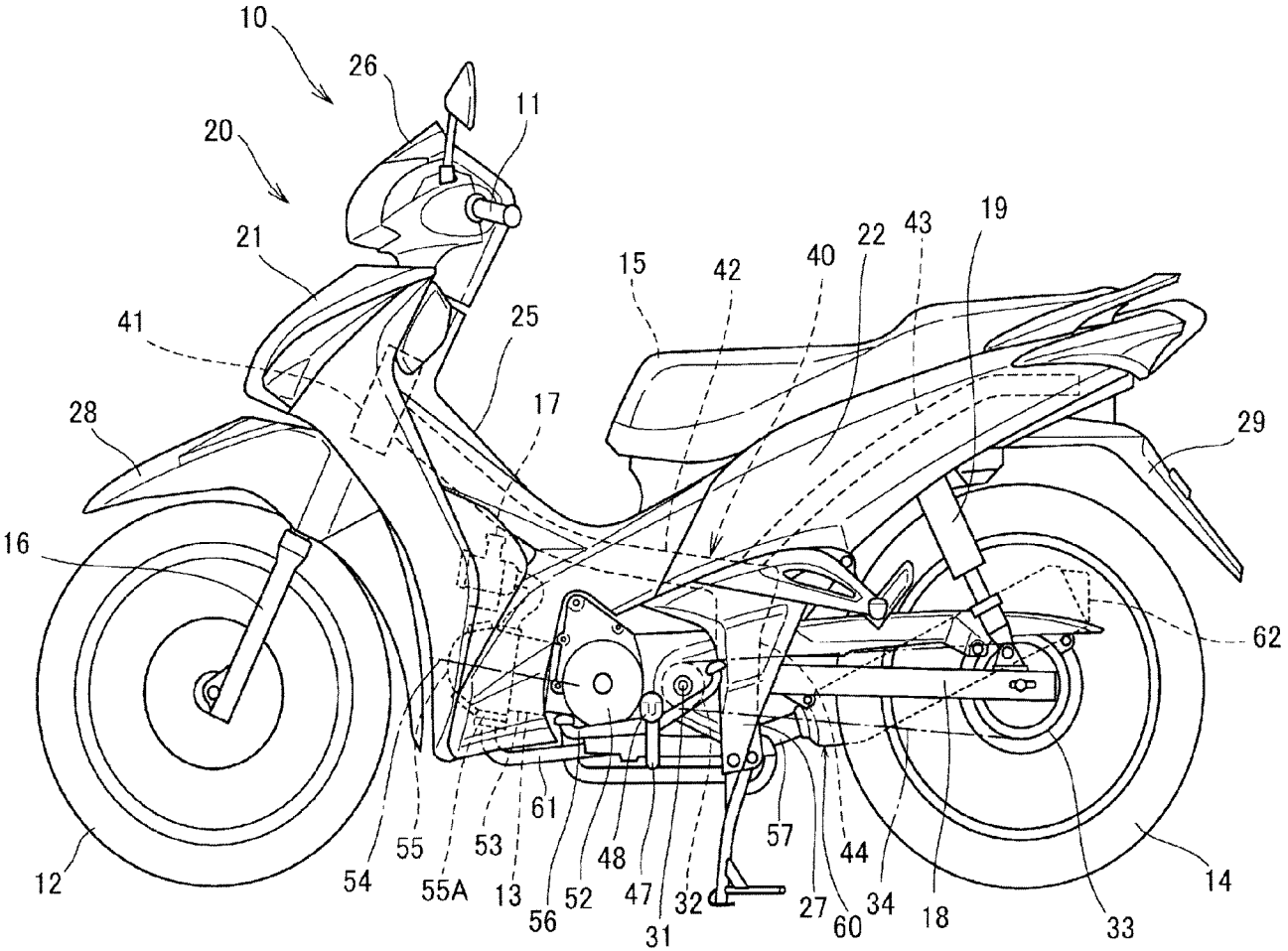
FIG. 1 is a left-side view of a motorcycle according to an embodiment of the present invention.

FIG. 1 is a left-side view of a motorcycle according to the embodiment of the present invention.

As shown in FIG. 1, a motorcycle 10 can include a front wheel 12 provided in such a way as to be steered by a handlebar 11 arranged in a front part of the vehicle. An engine 13 as a drive source can be arranged at the rear of the front wheel 12. A rear wheel 14 can be arranged at the rear of the engine 13 and driven by the engine 13. A seat 15 can be arranged between the front wheel 12 and the rear wheel 14. The motorcycle 10 in this embodiment is a saddle-ride type vehicle designed such that an occupant straddles and sits on the seat 15.

A vehicle body frame 40 of the motorcycle 10 can include a head pipe 41 steerably supporting a front fork 16 supporting the front wheel 12. A main frame 42 extends downwardly rearward from the head pipe 41 toward the rear of the vehicle. A pair of left and right seat rails 43 extend upwardly rearward from a rear portion of the main frame 42 to a rear part of the vehicle. A pair of left and right pivot plates 44 extend downward from a rear portion of the main frame 42.

A swingarm 18 rotationally supporting the rear wheel 14 is swingably supported on the pivot plates 44. A rear cushion 19 is laid between a rear portion of the swingarm 18 and a rear portion of the seat rail 43.

The motorcycle 10 is covered, in this embodiment, with a resin vehicle body cover 20. The vehicle body cover 20 includes a front cover 21 covering the front side of the vehicle.

A pair of left and right side covers 22 are provided continuously from a rear portion of the front cover 21 to the rear part of the vehicle and covering the lateral sides of the vehicle. An upper cover 25 is provided above the engine 13 and covers an upper part of the vehicle. A pivot-plate cover 27 covers the pivot plates 44.

A front fender 28 is arranged above the front wheel 12, and a handlebar cover 26 is arranged around the handlebar 11. A rear fender 29 is arranged above the rear wheel 14.

The engine 13 is supported on engine stays (not shown) in such a way as to be hung on the main frame 42.

The engine 13 can be, for example, a single-cylinder horizontal engine with a cylinder axis 54 extending substantially horizontally in the vehicle front-rear direction and includes a crankcase 52, a cylinder block 53, and a cylinder head 55 in this order from the rear of the vehicle. A transmission (not shown) is integrally provided in the crankcase 52. A change pedal 56 is provided to the crankcase 52.

An output shaft 31 of the engine 13 projects from the left side of the crankcase 52. The rear wheel 14 is driven in this embodiment by a chain 34 wound around and laid between a drive sprocket 32 of the output shaft 31 and a driven sprocket 33 of the rear wheel 14.

Step stays 47 extending in the vehicle width direction are attached to the lower surface of the engine 13, and a step or footrest 48 for the rider is provided on each step stay 47.

A throttle body 17 connected to an intake port of the cylinder head 55 is provided above the cylinder head 55.

An exhaust muffler device 60 is connected to an exhaust port 55A formed in the lower surface of the cylinder head 55. The exhaust muffler device 60 extends toward the rear part of the vehicle on a right side of the vehicle which is situated on the opposite side from the chain 34.

Figure 2:
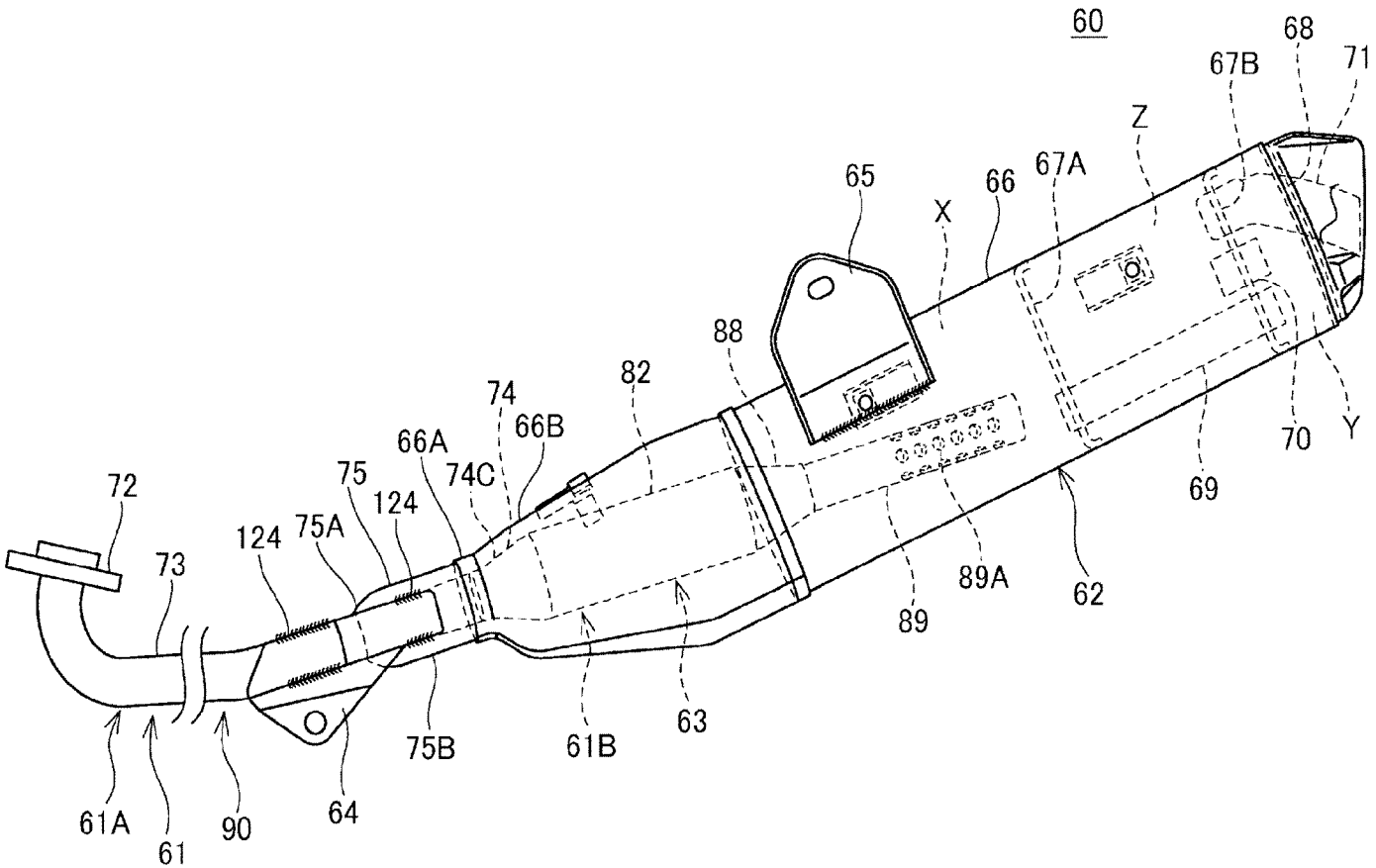
FIG. 2 is a side view of an exhaust muffler device.

FIG. 2 is a side view of the exhaust muffler device 60.

As shown in FIGS. 1 and 2, the exhaust muffler device 60 includes an exhaust pipe 61 connected to the exhaust port 55A and extending rearward. A muffler 62 connected to the exhaust pipe 61 and configured to reduce the pressure of high-temperature, high-pressure exhaust gas having flowed through the exhaust pipe 61 and exhaust it to the outside. A rear portion of the exhaust pipe 61 extends to the inside of the muffler 62. A catalytic unit 63 configured to purify exhaust gas is provided to the rear portion of the exhaust pipe 61 and is housed inside the muffler 62.

The exhaust muffler device 60 can be fixed to the vehicle body side with bolts or the like through a front hanger portion 64 provided to the exhaust pipe 61 and a rear hanger portion 65 provided to the muffler 62.

The muffler 62 includes a body case 66 (muffler body) formed in a cylindrical shape larger in diameter than the exhaust pipe 61 and is of a multistage expansion type in which the inner space of the body case 66 is divided into multiple expansion chambers X, Y, and Z by multiple partition walls 67A and 67B and a rear wall 68. The expansion chamber X on the front side and the expansion chamber Y on the rear side communicate with each other through a first communication pipe 69 which extends in the center of the expansion chamber Z and penetrates the partition walls 67A and 67B. The expansion chambers Y and Z communicate with each other through a second communication pipe 70 which penetrates the partition wall 67B. The expansion chamber Z communicates with the outside of the muffler 62 through a tail pipe 71 which penetrates the partition wall 67B and the rear wall 68.

In a front portion of the body case 66, a tapered portion 66B (small diameter portion) is formed which becomes smaller in diameter toward an upstream end 66A where the exhaust pipe 61 is connected.

Exhaust gas flows from the exhaust pipe 61 into the expansion chamber X, then flows through the first communication pipe 69 into the expansion chamber Y, then reverses the flow direction to flow through the second communication pipe 70 into the expansion chamber Z, then reverses the flow direction again to flow through the tail pipe 71, and is then exhausted to the outside.

Figure 3:
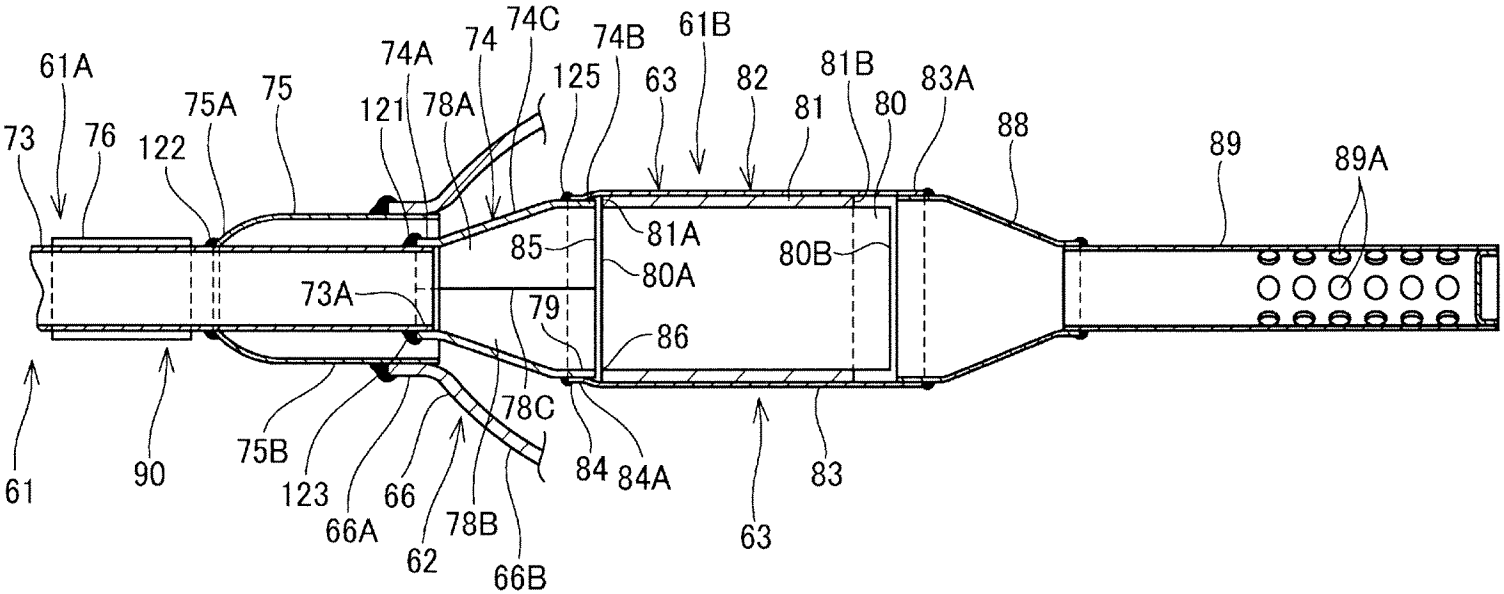
FIG. 3 is a cross-sectional view of a rear portion of an exhaust pipe.

FIG. 3 is a cross-sectional view of the rear portion of the exhaust pipe 61.

As shown in FIGS. 2 and 3, the exhaust pipe 61 is formed by joining multiple pipes by welding into a single pipe extending in the front-rear direction.

The exhaust pipe 61 includes an exhaust-pipe upstream portion 61A (an exhaust pipe connected to a holding tube) and an exhaust-pipe downstream portion 61B connected to the downstream end of the exhaust-pipe upstream portion 61A. The exhaust-pipe upstream portion 61A can include an exhaust-port connecting portion 72 connected to the exhaust port 55A and including a flange. A pipe portion 73 extends from the exhaust-port connecting portion 72 to the catalytic unit 63 side while maintaining substantially the same diameter. A downstream tapered pipe portion 74 (a downstream end portion of the exhaust pipe) extends from the pipe portion 73 and connected to the catalytic unit 63. An outer pipe 75 covering the pipe portion 73 from the outside with a gap being formed between itself and the pipe portion 73. The exhaust-pipe downstream portion 61B includes the catalytic unit 63, and a tapered pipe 88 and a pipe 89 connected to the downstream side of the catalytic unit 63.

The downstream tapered pipe portion 74 of the exhaust-pipe upstream portion 61A can include a front connecting portion 74A fitted to the outer circumferential surface of a rear end 73A of the pipe portion 73. A rear connecting portion 74B connected to the catalytic unit 63. A tapered portion 74C extending between the front connecting portion 74A and the rear connecting portion 74B in such a way as to become larger in diameter toward the rear connecting portion 74B on the downstream side. The front connecting portion 74A is welded from the outside by a weld bead 121.

Moreover, the downstream tapered pipe portion 74 is formed into a conical pipe by welding a pair of halved members 78A and 78B at their joining faces 78C, each of the halved members 78A and 78B being formed by pressing a metal sheet. In this way, it is possible to improve the design freedom for the tapered shape and also to improve the productivity.

The outer pipe 75 includes an end portion 75A having a reduced diameter at the upstream end. The end portion 75A fitted to the outer circumferential surface of the pipe portion 73 is welded and fixed thereto. The end portion 75A is welded from the outside by a weld bead 122. The downstream end of the outer pipe 75 is located in the vicinity of the rear end 73A of the pipe portion 73.

The upstream end 66A of the body case 66 of the muffler 62 is welded to an outer circumferential surface 75B of the outer pipe 75 from the outside by means of a weld bead 123. The space inside the tapered portion 66B of the muffler 62 and the outer pipe 75 is the expansion chamber X.

A reinforcing plate 76 having a semicircular cross-sectional shape is welded to the outer circumferential surface of the pipe portion 73 on a side upstream of the outer pipe 75. The front hanger portion 64 is welded and fixed to the reinforcing plate 76 and the outer pipe 75 from the outside by means of weld beads 124 (FIG. 2).

Figure 4:
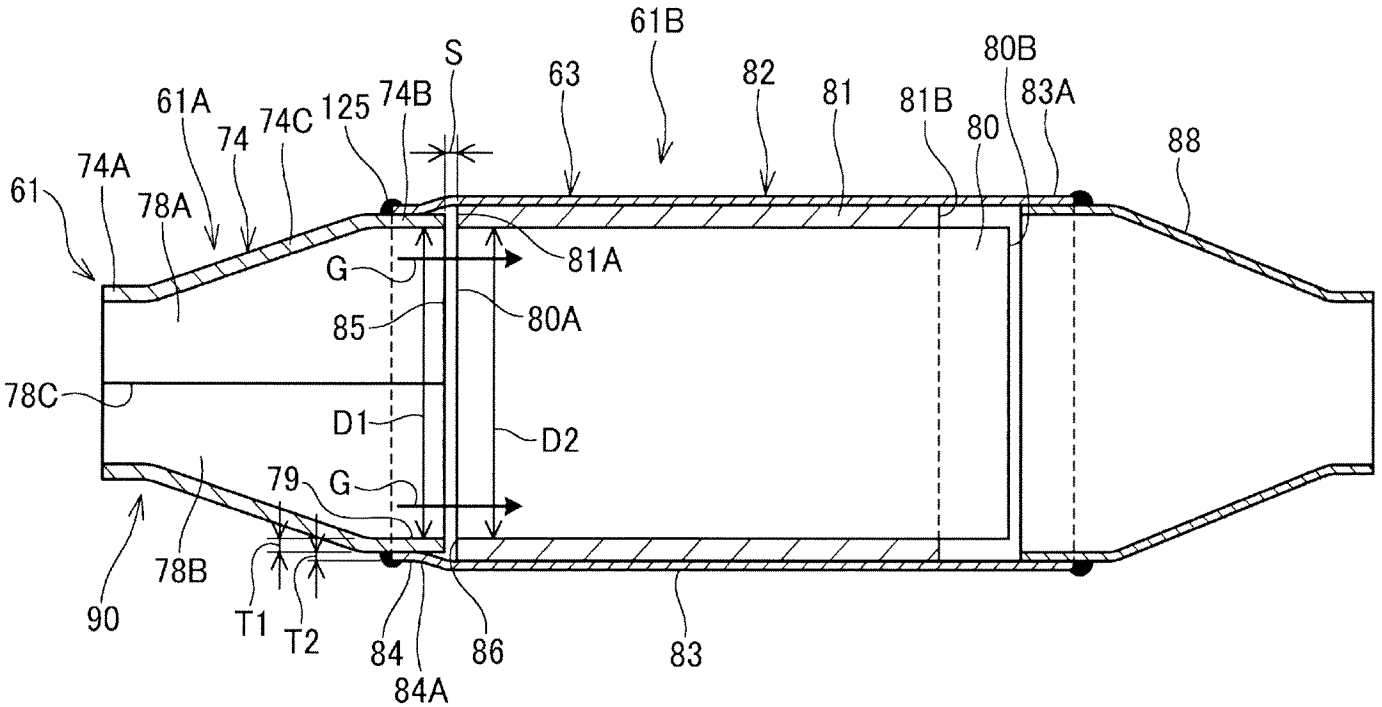
FIG. 4 is a cross-sectional view of a catalytic unit.

FIG. 4 is a cross-sectional view of the catalytic unit 63.

As shown in FIGS. 3 and 4, the catalytic unit 63 in this example is formed of a cylindrical ceramic catalyst body 80.

A holding mat 81 wrapped around the outer circumference of the catalyst body 80. A holding tube 82 holding the catalyst body 80 therein with the holding mat 81 in between.

The catalytic unit 63 is formed larger in diameter than the exhaust-pipe upstream portion 61A. Exhaust gas flowing from the exhaust-pipe upstream portion 61A into the catalytic unit 63 is purified by the catalyst body 80 and its pressure is relieved as well.

Inside its cylindrical outer layer, the catalyst body 80 has a honeycomb porous structure having a number of fine pores extending in the axial direction and is formed to have a large surface area in the inside. Platinum, rhodium, and palladium which decompose components in exhaust gas are supported as catalysts in the wall of each of the fine pores. As the base material of the catalyst body 80, a porous ceramic can be used, so that catalysts such as platinum and rhodium are easily supported. Here, as some preferable examples of the ceramic material, various kinds of heat-resistant ceramics including cordierite, mullite, alumina, an alkaline earth metal aluminate, silicon carbide, silicon nitride, and the like, or similar materials are available.

The holding mat 81 is formed into a long mat shape by compressing or accumulating ceramic fibers and is wrapped around the outer surface of the catalyst body 80 and sandwiched between the catalyst body 80 and the holding tube 82. The holding mat 81 has relatively large elasticity because it is an assembly of fibers intertwining with each other. Here, the material of the holding mat 81 can be any material as long as it is heat resistant and elastic, and it is possible to use one in which metallic fibers are accumulated, glass wool, or the like.

The holding mat 81 is formed such that the longitudinal length thereof in the state of being wrapped around the catalyst body 80 is smaller than the longitudinal (axial) length of the catalyst body 80.

As the material of the holding tube 82, a metal high in strength and heat resistance is used, and it is possible to use steel such as stainless steel, for example.

The holding tube 82 can include a cylindrical straight portion 83 extending in the axial direction while maintaining the same diameter. A reduced diameter portion 84A formed in an end portion 84 on an upstream side of the gas exhaustion (end portion on one side). The reduced diameter portion 84A is formed by a drawing process to reduce the diameter of the end of the straight portion 83 having the same thickness along the axial direction, so that the reduced diameter portion 84A has a smaller outer diameter and a smaller inner diameter. The entire length of the holding tube 82 is larger than the entire length of the catalyst body 80.

As shown in FIG. 4, the rear connecting portion 74B of the downstream tapered pipe portion 74 of the exhaust-pipe upstream portion 61A is fitted to an inner circumferential portion of the reduced diameter portion 84A and is welded from the outside by means of a weld bead 125. The position of an end face 85 of the rear connecting portion 74B substantially coincides with the position of a tip of the straight portion 83.

In this embodiment, thickness T1 of the rear connecting portion 74B is set larger than thickness T2 of the reduced diameter portion 84A. Development of a back bead of the weld bead 125 can be prevented by making the thickness T1 of the rear connecting portion 74B inside the reduced diameter portion 84A larger than the thickness T2 of the reduced diameter portion 84A as described above. In this way, it is possible to prevent development of a back bead on the inner circumferential surface of the rear connecting portion 74B which exhaust gas flows along, and thereby to improve the exhaust efficiency. Here, in one example, the thickness T1 is 2 mm, and the thickness T2 is 1 mm. Making the thickness T1 two or more times greater than the thickness T2 is preferable in light of preventing the development of the back bead. Moreover, the thickness of the downstream tapered pipe portion 74 is uniform and is the same thickness as the thickness T1 over the entire area.

The catalyst body 80 can be assembled into the holding tube 82 by being press-fitted thereinto from a downstream end 83A on the opposite side from the reduced diameter portion 84A (an end portion on the other side; a downstream end on the opposite side from the exhaust pipe) with the holding mat 81 being wrapped around the outer circumference.

An upstream end 80A of the catalyst body 80 and an upstream end 81A of the holding mat 81 are in proximity to each other so that they can be located at substantially the same position in the axial direction of the holding tube 82, and are also inserted to such a position that a gap S is secured between them and the end face 85 of the rear connecting portion 74B. The gap S is set to be as small as possible with no contact between the end face 85 and the catalyst body 80, by taking the dimensional tolerance and thermal expansion of each component into consideration.

Morever, the rear connecting portion 74B is formed such that its inner diameter D1 may be substantially the same as diameter D2 of a boundary portion 86 of the holding mat 81 and the catalyst body 80 in the radial direction. An inner circumferential surface 79 of the rear connecting portion 74B and the boundary portion 86 are located at substantially the same position in the radial direction. Here, the diameter D2 coincides with the inner diameter of the holding mat 81 and the outer diameter of the catalyst body 80.

The flow of exhaust gas flowing from the rear connecting portion 74B into the catalyst body 80 can be made smooth by making the gap S as small as possible and also making the inner diameter D1 of the rear connecting portion 74B and the diameter D2 of the boundary portion 86 substantially the same as described above. Specifically, exhaust gas G flowing along the inner circumferential surface 79 of the downstream tapered pipe portion 74 flows along the inner circumferential surface of the rear connecting portion 74B straight into the catalyst body 80, thereby making it possible to prevent the exhaust gas G from directly hitting the upstream end 81A of the holding mat 81. Accordingly, it is possible to reduce an influence such as heat which the exhaust gas G exerts on the holding mat 81, and also to make the flow of the exhaust gas G smooth and thereby improve the exhaust efficiency and therefore improve the engine performance.

Moreover, the upstream end 80A of the catalyst body 80 and the upstream end 81A of the holding mat 81 are in proximity to each other so that they can be located at substantially the same position in the axial direction of the holding tube 82. This makes it possible to prevent formation of an unnecessary space in the portion of the gap S due to displacement between the upstream end 80A and the upstream end 81A. Accordingly, it is possible to prevent the exhaust gas from becoming turbulent and thereby improve the engine performance.

Further, the reduced diameter portion 84A is provided to the holding tube 82, and the rear connecting portion 74B of the downstream tapered pipe portion 74 is fitted in the reduced diameter portion 84A. Thus, even if the thickness of the holding mat 81 is large in the configuration where the inner diameter D1 and the diameter D2 are set to be substantially the same, the thickness of the downstream tapered pipe portion 74 does not need to be large beyond its necessity. Accordingly, it is possible to achieve reduction in weight.

The entire length of the catalyst body 80 is larger than the entire length of the holding mat 81, and the upstream end 80A and the upstream end 81A are so arranged as to coincide with each other in the axial direction. This makes it possible to prevent a downstream end 81B of the holding mat 81 from sticking out beyond a downstream end 80B of the catalyst body 80 in the axial direction. Accordingly, the holding mat 81 does not create any obstruction, thereby allowing good workability of the press fitting.

As shown in FIG. 3, the tapered pipe 88 (downstream exhaust pipe) which becomes smaller in diameter toward the downstream side of the gas exhaustion is fitted and welded to an inner circumferential portion of the downstream end 83A of the holding tube 82. The pipe 89 with a closed rear end is connected to the downstream end of the tapered pipe 88. Exhaust gas flows into the expansion chamber X through multiple small holes 89A formed in the outer circumferential surface of the pipe 89.

As shown in FIG. 2, the catalytic unit 63 is formed longer in the axial direction than in the radial direction; such an elongate catalytic unit 63 can still secure sufficient strength because its surrounding area is covered with the body case 66 of the muffler 62. Moreover, because the catalytic unit 63 is elongate, the radial size of the muffler 62 can be reduced. Accordingly, the exhaust muffler device 60 can easily be arranged in a saddle-ride type vehicle that has a limited arrangement space.

Moreover, since the catalytic unit 63 is housed inside the body case 66, it is possible to protect components arranged in the periphery of the muffler 62 from the radiant heat of the catalytic unit 63. Further, since the single catalyst body 80 is arranged in the tapered portion 66B formed to have a small diameter on the upstream side of the body case 66. Accordingly, it is possible to reduce the size of the muffler 62 and also to quickly activate the catalyst body 80 with the heat of exhaust gas.

Now, processes for manufacturing the exhaust muffler device 60 will be described.

The exhaust muffler device 60 is assembled by connecting the exhaust-pipe downstream portion 61B including the catalytic unit 63 and the exhaust-pipe upstream portion 61A to each other and then by connecting the body case 66 thereto.

Figure 5:
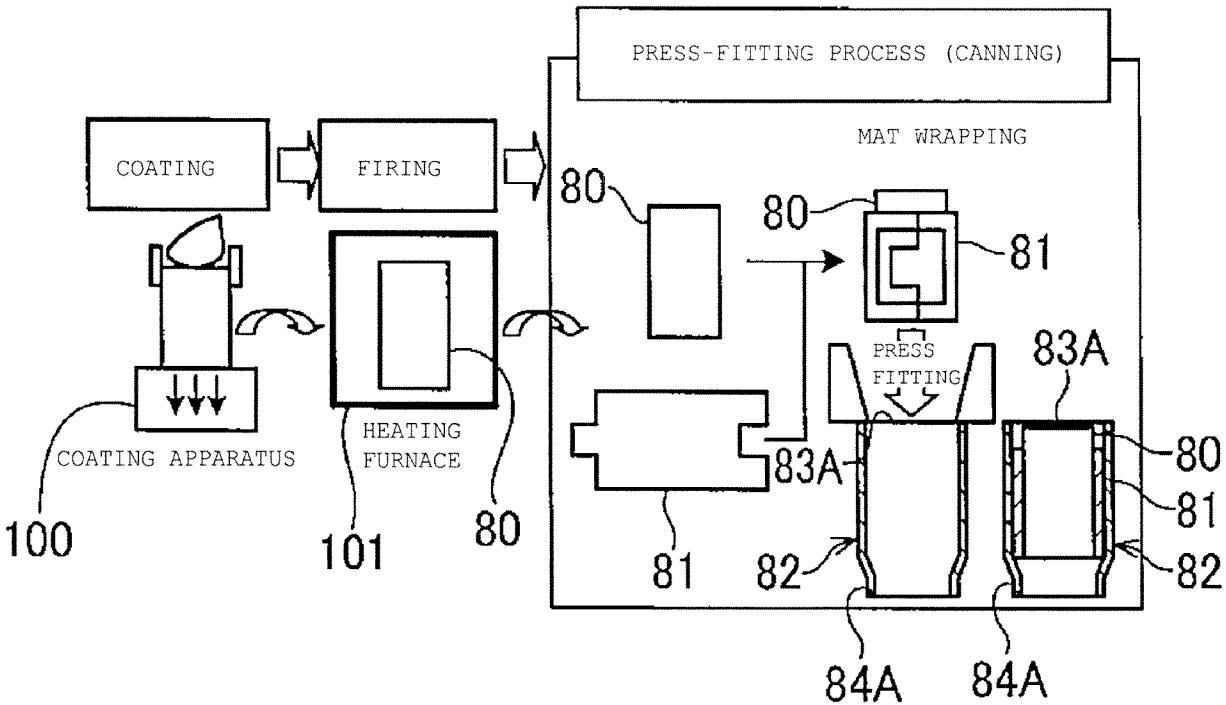
FIG. 5 is a diagram showing processes for manufacturing the catalytic unit.

FIG. 5 is a diagram showing processes for manufacturing the catalytic unit 63.

As shown in FIG. 5, a cylindrical base material is coated with a solution of a catalyst composition by a coating apparatus 100 and is then fired by a heating furnace 101, so that the catalyst composition is fixed to the base material. As a result, the catalyst body 80 is formed. The coating and firing processes can be performed once, or multiple times.

In a press-fitting process, the holding mat 81 is wrapped around the catalyst body 80, and the catalyst body 80 and the holding mat 81 are press-fitted into the holding tube 82 from the downstream end 83A on the opposite side from the reduced diameter portion 84A. As a result, the catalytic unit 63 is completed. Thereafter, the tapered pipe 88 integrally welded to the pipe 89 (FIG. 3) is fitted and welded to the inner circumferential portion of the downstream end 83A of the catalytic unit 63.

Note that although the coating and firing processes are described here as processes performed prior to the press-fitting process, the present invention is not limited to this case. The coating and firing may be performed only in a process after the press-fitting process or in both processes before and after the press-fitting process.

As shown in FIG. 3, the exhaust-pipe upstream portion 61A is prepared as a sub-assembly 90 formed by integrally welding, in advance, the exhaust-port connecting portion 72 (FIG. 2), the pipe portion 73, the downstream tapered pipe portion 74, the outer pipe 75, the reinforcing plate 76, and the front hanger portion 64. Once the sub-assembly 90 is formed, the presence of a back bead is checked for the weld beads 121, 122, and 124 and the welded portions of the reinforcing plate 76. The back bead can be removed if necessary.

Then, the rear connecting portion 74B of the downstream tapered pipe portion 74 of the sub-assembly 90 is fitted into the reduced diameter portion 84A of the holding tube 82 and is welded and thus fixed by the weld bead 125. Here, since the thickness T1 of the rear connecting portion 74B is set larger than the thickness T2 of the reduced diameter portion 84A, it is possible to prevent development of a back bead of the weld bead 125.

In this embodiment, the exhaust-pipe upstream portion 61A is formed as the sub-assembly 90 so that the inside of the exhaust-pipe upstream portion 61A can be checked before inserting the rear connecting portion 74B into the reduced diameter portion 84A. In addition, the thickness T1 of the rear connecting portion 74B is made larger so as to prevent development of a back bead of the weld bead 125 that welds the reduced diameter portion 84A and the sub-assembly 90 together. Thus, it is possible to prevent a back bead from being formed inside the pipe upstream of the catalyst body 80. Accordingly, it is possible to prevent a back bead upstream of the catalyst body 80 from falling and entering the catalyst body 80.

Moreover, a front portion of the front hanger portion 64 is welded to the reinforcing plate 76 provided on the surface of the pipe portion 73. Thus, it is possible to prevent back beads of the front weld beads 124 from being formed inside the pipe portion 73. Further, although a rear portion of the front hanger portion 64 is welded to the outer pipe 75, development of back beads of the rear weld beads 124 is tolerable because the inside of the outer pipe 75 is situated downstream of the catalyst body 80 in terms of the flow of exhaust gas. Accordingly, the welding can be easily accomplished.

After welding the sub-assembly 90 and the catalytic unit 63 with the weld bead 125, a rear portion of the exhaust-pipe upstream portion 61A and the catalytic unit 63 are inserted into the body case 66 of the muffler 62, and the upstream end 66A of the body case 66 is fitted and welded to the outer circumferential surface 75B of the outer pipe 75 with the weld bead 123. Development of a back bead of the weld bead 123 is tolerable because the body case 66 is welded to the outer pipe 75 situated downstream of the catalyst body 80 in terms of the flow of the exhaust gas. Accordingly, the welding can be easily accomplished.

As described above, according to the embodiment to which the present invention is applied, the end portion 84 of the holding tube 82 which holds the catalyst body 80 therein with the holding mat 81 in between is reduced in diameter to form the reduced diameter portion 84A. The rear connecting portion 74B of the downstream tapered pipe portion 74, which is a downstream end portion of the exhaust-pipe upstream portion 61A connected to the holding tube 82, is fitted to the inner circumference of the reduced diameter portion 84A of the holding tube 82. The end portion 84 of the holding tube 82 is welded and fixed to the rear connecting portion 74B of the exhaust-pipe upstream portion 61A in such a way that the inner circumferential surface 79 of the rear connecting portion 74B of the exhaust-pipe upstream portion 61A is in proximity to the boundary portion 86 of the holding mat 81 and the catalyst body 80. Thus, the exhaust gas G flowing along the inner circumferential surface 79 of the rear connecting portion 74B of the exhaust-pipe upstream portion 61A flows into the catalyst body 80 smoothly, without directly hitting the holding mat 81. Accordingly, it is possible to prevent a large amount of exhaust gas from entering the inside of holding mat 81 and also to prevent the flow of the exhaust gas from becoming turbulent in the vicinity of the holding mat 81.

Moreover, the inner circumferential surface 79 of the rear connecting portion 74B of the downstream tapered pipe portion 74 of the exhaust-pipe upstream portion 61A and the boundary portion 86 are located at substantially the same portion in the radial direction. Thus, exhaust gas flowing along the inner circumferential surface 79 of the rear connecting portion 74B flows into the catalyst body 80 smoothly, without directly hitting the holding mat 81. Accordingly, it is possible to prevent a large amount of exhaust gas from entering the inside of holding mat 81 and also to prevent the flow of the exhaust gas from becoming turbulent in the vicinity of the holding mat 81.

Moreover, the holding mat 81 is formed such that its longitudinal size may be smaller than the longitudinal size of the catalyst body 80. The upstream end 81A of the holding mat 81 adjacent to the downstream tapered pipe portion 74 of the exhaust-pipe upstream portion 61A is provided in proximity to the upstream end 80A of the catalyst body 80 adjacent to the downstream tapered pipe portion 74. Thus, at the time of assembling the catalyst body 80 into the holding tube 82 by press fitting, the downstream end 81B of the holding mat 81 can be prevented from sticking out in the longitudinal direction. Moreover, an unnecessary space can be prevented from being formed around the downstream tapered pipe portion 74 of the exhaust-pipe upstream portion 61A due to displacement between the upstream end 81A of the holding mat 81 and the upstream end 80A of the catalyst body 80. Accordingly, it is possible to improve the workability of the assembling and also to prevent exhaust gas from becoming turbulent and thereby improve engine performance.

Further, the catalyst body 80 is assembled into the holding tube 82 by inserting the catalyst body 80 with the holding mat 81 wrapped therearound into the holding tube 82 together with the holding mat 81 from the downstream end 83A of the holding tube 82 on the opposite side from the exhaust-pipe upstream portion 61A. Thus, the reduced diameter portion 84A can be formed in the holding tube 82 in advance. Accordingly, it is possible to form the reduced diameter portion 84A in a state where the catalyst body 80 is yet to be assembled and therefore improve productivity.

Moreover, the end portion 84 of the holding tube 82 on one side is reduced in diameter to form the reduced diameter portion 84A. The tapered pipe 88 is inserted and connected to the inner circumferential portion of the downstream end 83A which is the end portion of the holding tube 82 on the other side. Thus, the catalyst body 80 and the holding mat 81 can be assembled from the downstream end 83A of the holding tube 82 by press fitting, after forming the reduced diameter portion 84A. Accordingly, it is possible to improve productivity.

Moreover, the downstream tapered pipe portion 74 of the exhaust-pipe upstream portion 61A is formed into a conical, tapered shape by joining the halved members 78A and 78B formed by pressing a sheet member. Accordingly, it is possible to improve the design freedom for the tapered shape and also to improve the productivity.

Moreover, the motorcycle 10, which is a saddle-ride type vehicle, needs to protect peripheral components from the radiant heat of the catalyst body 80. Since the holding tube 82 is housed inside the body case 66 of the muffler 62, it is possible to protect the peripheral components from the radiant heat. Moreover, since the single catalyst body 80 is arranged in the tapered portion 66B in an upstream side of the inside of the body case 66, it is possible to reduce the size of the muffler 62 and also to quickly activate the catalyst body 80.

It should be noted that the foregoing embodiment only shows one mode to which the present invention is applied and that the present invention is not limited to the foregoing embodiment.

Although the reduced diameter portion 84A has been described in the foregoing embodiment as a portion formed by a drawing process to reduce the diameter of an end of the straight portion 83, the present invention is not limited to this case. For example, a reduced diameter portion may be formed by fitting a pipe-shaped spacer to an inner circumferential portion of the end of the straight portion 83 to reduce the inner diameter of the straight portion 83.

EXPLANATION OF THE REFERENCE NUMERALS

10 MOTORCYCLE (SADDLE-RIDE TYPE VEHICLE)
13 ENGINE
60 EXHAUST MUFFLER DEVICE
61A EXHAUST-PIPE UPSTREAM PORTION (EXHAUST PIPE CONNECTED TO HOLDING TUBE)
66 BODY CASE (MUFFLER BODY)
66B TAPERED PORTION (SMALL DIAMETER PORTION)
74 DOWNSTREAM TAPERED PIPE PORTION (DOWNSTREAM END PORTION OF EXHAUST PIPE)
78A, 78B HALVED MEMBER
79 INNER CIRCUMFERENTIAL SURFACE
80 CATALYST BODY (CERAMIC CATALYST BODY)
80A UPSTREAM END (END PORTION OF CATALYST BODY ADJACENT TO DOWNSTREAM END PORTION OF EXHAUST PIPE)
81 HOLDING MAT
81A UPSTREAM END (END PORTION OF HOLDING MAT ADJACENT TO DOWNSTREAM END PORTION OF EXHAUST PIPE)
82 HOLDING TUBE
83A DOWNSTREAM END (END PORTION ON THE OTHER SIDE; DOWNSTREAM END ON OPPOSITE SIDE FROM EXHAUST PIPE)
84 END PORTION (END PORTION ON ONE SIDE)
84A REDUCED DIAMETER PORTION
86 BOUNDARY PORTION
88 TAPERED PIPE (DOWNSTREAM EXHAUST PIPE)

The invention claimed is:

1. An exhaust muffler device for an engine, said exhaust muffler device comprising:

a ceramic catalyst body;

a holding tube having an end portion configured to hold the ceramic catalyst body therein with a holding mat therebetween, said end portion being reduced in diameter to form a reduced diameter portion;

an exhaust pipe having a downstream end portion thereof connected to the holding tube, said downstream end portion being fitted to an inner circumference of the reduced diameter portion of the holding tube, wherein the end portion of the holding tube is welded and fixed to the downstream end portion of the exhaust pipe wherein an inner circumferential surface of the downstream end portion of the exhaust pipe is in proximity to a boundary portion of the holding mat and the ceramic catalyst body.

2. The exhaust muffler device according to claim 1, wherein the inner circumferential surface of the downstream end portion of the exhaust pipe and the boundary portion are located at substantially a same position in a radial direction.

3. The exhaust muffler device according to claim 1, wherein the holding mat is formed such that a longitudinal size thereof is smaller than the longitudinal size of the ceramic catalyst body, and wherein an end portion of the holding mat adjacent to the downstream end portion of the exhaust pipe is provided in proximity to an end portion of the ceramic catalyst body adjacent to the downstream end portion of the exhaust pipe.

4. The exhaust muffler device according to claim 1, wherein the ceramic catalyst body is assembled into the holding tube by inserting the ceramic catalyst body with the holding mat wrapped therearound into the holding tube together with the holding mat from a downstream end of the holding tube on an opposite side from the exhaust pipe.

5. The exhaust muffler device according to claim 1, further comprising a downstream exhaust pipe connected to the downstream end of the holding tube, wherein the end portion of the holding tube on one side is reduced in diameter to form the reduced diameter portion in advance, and wherein the downstream exhaust pipe is inserted and connected to an inner circumferential portion of an end portion of the holding tube on another side.

6. The exhaust muffler device according to claim 1, wherein the downstream end portion of the exhaust pipe comprises a conical, tapered shape having joined halved members formed by pressing a sheet member.

7. The exhaust muffler device according to claim 1, wherein the exhaust muffler device comprises an exhaust muffler device for a saddle-ride type vehicle in which the holding tube is housed inside a muffler body, and wherein the ceramic catalyst body comprises a single body arranged in a small diameter portion in an upstream side of an inside of the muffler body.

8. A method of manufacturing an exhaust muffler device for an engine, said method comprising:

providing a ceramic catalyst body;

providing a holding tube having an end portion configured to hold the ceramic catalyst body therein;

inserting the ceramic catalyst body with a holding mat wrapped therearound into the holding tube together with the holding mat from a downstream end of the holding tube;

providing an exhaust pipe having a downstream end portion thereof connected to the holding tube on an opposite side of the holding tube;

wherein the end portion of the holding tube is welded and fixed to the downstream end portion of the exhaust pipe, whereby an inner circumferential surface of the downstream end portion of the exhaust pipe is in proximity to a boundary portion of the holding mat and the ceramic catalyst body.

9. The method of assembling an exhaust muffler device according to claim 8, wherein the step of providing the exhaust pipe comprises providing the exhaust pipe such that the inner circumferential surface of the downstream end portion and a boundary portion are located at substantially a same position in a radial direction.

10. The method according to claim 8, wherein the inserting of the ceramic catalyst body with the holding mat comprises inserting the ceramic catalyst body with the holding mat having a longitudinal size thereof being smaller than a longitudinal size of the ceramic catalyst body, and wherein an end portion of the holding map adjacent to the downstream end portion of the exhaust pipe is provided in proximity to an end portion of the ceramic catalyst body adjacent to the downstream end portion of the exhaust pipe.

11. An exhaust muffler device for an engine, said exhaust muffler device comprising:

ceramic catalyst body means for housing catalyst components therein;

holding tube means for holding the ceramic catalyst body means therein with a holding mat therebetween, said holding tube means having an end portion being reduced in diameter to form a reduced diameter portion, said end portion holding the ceramic catalyst body means therein;

exhaust pipe means having a downstream end portion connected to the holding tube means, said downstream end portion for being fitted to an inner circumference of the reduced diameter portion of the holding tube means, wherein the end portion of the holding tube means is welded and fixed to the downstream end portion of the exhaust pipe means such that an inner circumferential surface of the downstream end portion of the exhaust pipe means is in proximity to a boundary portion of the holding mat and the ceramic catalyst body means.

12. The exhaust muffler device according to claim 11, wherein the inner circumferential surface of the downstream end portion of the exhaust pipe means and the boundary portion are located at substantially a same position in a radial direction.

13. The exhaust muffler device according to claim 11, wherein the holding mat is formed such that a longitudinal size thereof is smaller than the longitudinal size of the ceramic catalyst body means, and wherein an end portion of the holding mat adjacent to the downstream end portion of the exhaust pipe means is provided in proximity to an end portion of the ceramic catalyst body means adjacent to the downstream end portion of the exhaust pipe means.

14. The exhaust muffler device according to claim 11, wherein the ceramic catalyst body means is assembled into the holding tube means by inserting the ceramic catalyst body means with the holding mat wrapped therearound into the holding tube means together with the holding mat from a downstream end of the holding tube means on an opposite side from the exhaust pipe means.

15. The exhaust muffler device according to claim 11, further comprising a downstream exhaust pipe means connected to the downstream end of the holding tube means, wherein the end portion of the holding tube means on one side is reduced in diameter to form the reduced diameter portion in advance, and wherein the downstream exhaust pipe means is inserted and connected to an inner circumferential portion of an end portion of the holding tube means on another side.

16. The exhaust muffler device according to claim 11, wherein the downstream end portion of the exhaust pipe means comprises a conical, tapered shape having joined halved members formed by pressing a sheet member.

17. The exhaust muffler device according to claim 11, wherein the exhaust muffler device comprises an exhaust muffler device for a saddle-ride type vehicle in which the holding tube means is housed inside a muffler body, and wherein the ceramic catalyst body means comprises a single body arranged in a small diameter portion in an upstream side of an inside of the muffler body.

18. The exhaust muffler device according to claim 1, wherein the distance between the downstream end portion of the exhaust pipe and the boundary portion of the holding mat corresponds to a distance for dimensional tolerance and thermal expansion.

19. The method of assembling an exhaust muffler device according to claim 8, wherein the distance between the downstream end portion of the exhaust pipe and the boundary portion of the holding mat corresponds to a distance for dimensional tolerance and thermal expansion.

20. The exhaust muffler device according to claim 11, wherein the distance between the downstream end portion of the exhaust pipe and the boundary portion of the holding mat corresponds to a distance for dimensional tolerance and thermal expansion.

* * * * *